US010485336B1

(12) United States Patent
Laudadio et al.

(10) Patent No.: US 10,485,336 B1
(45) **Date of Patent: *Nov. 26, 2019**

(54) MOTORIZED, HEIGHT-ADJUSTABLE DESKTOP SYSTEM

(71) Applicant: Versa Products, Inc., Los Angeles, CA (US)

(72) Inventors: Christopher Laudadio, Los Angeles, CA (US); Aryan Jafari, Los Angeles, CA (US)

(73) Assignee: Versa Products, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/514,964

(22) Filed: Jul. 17, 2019

Related U.S. Application Data

(63) Continuation of application No. 15/642,842, filed on Jul. 6, 2017.

(60) Provisional application No. 62/359,996, filed on Jul. 8, 2016.

(51) Int. Cl.

| | |
|---|---|
| ***A47B 23/04*** | (2006.01) |
| ***A47B 21/02*** | (2006.01) |
| ***A47B 21/06*** | (2006.01) |
| ***A47B 21/04*** | (2006.01) |
| ***A47B 9/18*** | (2006.01) |
| ***A47B 9/16*** | (2006.01) |
| ***A47B 21/03*** | (2006.01) |

(52) U.S. Cl.
CPC ..... *A47B 23/04* (2013.01); *A47B 9/16* (2013.01); *A47B 9/18* (2013.01); *A47B 21/02* (2013.01); *A47B 21/0314* (2013.01); *A47B 21/04* (2013.01); *A47B 21/06* (2013.01); *A47B 2021/0335* (2013.01); *A47B 2023/049* (2013.01); *A47B 2200/0082* (2013.01)

(58) Field of Classification Search
CPC .... A47B 9/16; A47B 9/10; A47B 9/18; A47B 21/02; A47B 21/0314
USPC ..... 108/145, 147
See application file for complete search history.

(56) References Cited

U.S. PATENT DOCUMENTS

| | | | | | |
|---|---|---|---|---|---|
| 4,625,657 | A * | 12/1986 | Little | A47B 21/0314 | 108/138 |
| 5,746,138 | A * | 5/1998 | Hirose | B25J 9/106 | 108/143 |
| 5,771,814 | A * | 6/1998 | Clausen | A47B 21/0314 | 108/93 |
| 6,269,753 | B1 * | 8/2001 | Roddan | A47B 21/00 | 108/50.01 |
| 6,286,812 | B1 * | 9/2001 | Cherry | B66F 7/065 | 254/122 |
| 6,397,763 | B1 * | 6/2002 | Panzarella | A47B 21/0314 | 108/138 |

(Continued)

*Primary Examiner* — Jose V Chen
(74) *Attorney, Agent, or Firm* — Marin Patents LP; Gustavo Marin

(57) ABSTRACT

A motorized desktop stand unit having a main surface assembly designed to accommodate a monitor or laptop and a secondary surface assembly designed to accommodate a keyboard. The desktop stand unit also has a frame assembly having an upper frame and a lower frame. An elevation mechanism is provided between the upper frame and lower frame. A switch provided in the main surface assembly, when actuated, causes the elevation mechanism to adjust the space between the upper frame and lower frames, changing the height of the main surface assembly.

4 Claims, 9 Drawing Sheets

(56) References Cited

U.S. PATENT DOCUMENTS

| | | | | |
|---|---|---|---|---|
| 6,585,214 | B1 * | 7/2003 | Dittmer | F16M 11/38 248/370 |
| 7,677,518 | B2 * | 3/2010 | Chouinard | A47B 21/02 108/10 |
| 7,950,338 | B2 * | 5/2011 | Smed | A47B 9/16 108/119 |
| 8,947,215 | B2 * | 2/2015 | Mandel | G06Q 10/109 108/147 |
| 9,055,810 | B2 * | 6/2015 | Flaherty | A47B 9/18 |
| 9,326,598 | B1 * | 5/2016 | West | A47B 3/02 |
| 9,332,839 | B2 * | 5/2016 | Ringlein | A47B 87/002 |
| 9,504,316 | B1 * | 11/2016 | Streicher | A47B 21/02 |
| 9,615,655 | B1 * | 4/2017 | Huang | A47B 9/16 |
| 9,681,746 | B1 * | 6/2017 | Chen | A47B 9/02 |
| 2004/0149177 | A1 * | 8/2004 | Gayhart | A47B 21/06 108/50.02 |
| 2005/0284341 | A1 * | 12/2005 | Klassy | A47B 21/00 108/50.02 |
| 2013/0145972 | A1 * | 6/2013 | Knox | B60N 3/063 108/145 |
| 2015/0289641 | A1 * | 10/2015 | Ergun | A47B 9/16 108/42 |
| 2016/0249737 | A1 * | 9/2016 | Han | A47B 9/02 108/145 |
| 2016/0286951 | A1 * | 10/2016 | Chung | A47B 9/16 |
| 2016/0338486 | A1 * | 11/2016 | Martin | A47B 9/16 |

* cited by examiner

MOTORIZED, HEIGHT-ADJUSTABLE DESKTOP SYSTEM

CROSS-REFERENCE TO RELATED APPLICATIONS

This application claims the benefit of, and priority to, U.S. Nonprovisional patent application Ser. No. 15/642,842 filed Jul. 5, 2017 and entitled "MOTORIZED, HEIGHT-ADJUSTABLE DESKTOP SYSTEM," which claims priority to U.S. Provisional Patent Application No. 62/359,996 filed Jul. 8, 2016 and entitled "MOTORIZED, HEIGHT-ADJUSTABLE DESKTOP SYSTEM," the entire specifications of which are incorporated herein by reference.

BACKGROUND OF THE INVENTION

Field of the Art

The disclosure relates generally to computer furniture, in particular, a motorized, height-adjustable desktop or a motorized standing desk converter.

As the computer has become a centerpiece of work and other daily activities, there has become a need for height-adjustable computer furniture, in particular, a furniture system that allow for a user to go from a sitting position in front of a computer to a standing position in front of a computer with ease. It has been shown that sitting for long periods of time can be harmful to one's heath. As such, these systems allow for a user to continue to use a computer while changing his/her position from standing from sitting, alleviating back pain commonly attributed to sitting for long periods, for example.

In order to convert computer furniture from a position in which a user is sitting to a position in which a user is standing, various lift mechanisms have been used. One example is a manual, spring-assisted lift mechanism. However, such a manual mechanism requires a user to lift the portion of the desktop, a desktop which often has heavy computer equipment thereon. General examples of older systems include those disclosed in U.S. Pat. No. 5,868,079 and U.S. Patent Publication No. 2008/0203865.

Accordingly, there is a need for an improved, height-adjustable desktop system that allows a user to achieve a desired desktop height without manual adjustment.

BRIEF DESCRIPTION OF THE DRAWING FIGURES

The accompanying drawings illustrate several embodiments of the invention and, together with the description, serve to explain the principles of the invention according to the embodiments. It will be appreciated by one skilled in the art that the particular embodiments illustrated in the drawings are merely exemplary, and are not to be considered as limiting of the scope of the invention or the claims herein in any way.

A more complete understanding of the present invention may be obtained by reference to the Detailed Description when taken in conjunction with the accompanying Drawings.

SUMMARY OF THE INVENTION

Figure 1:
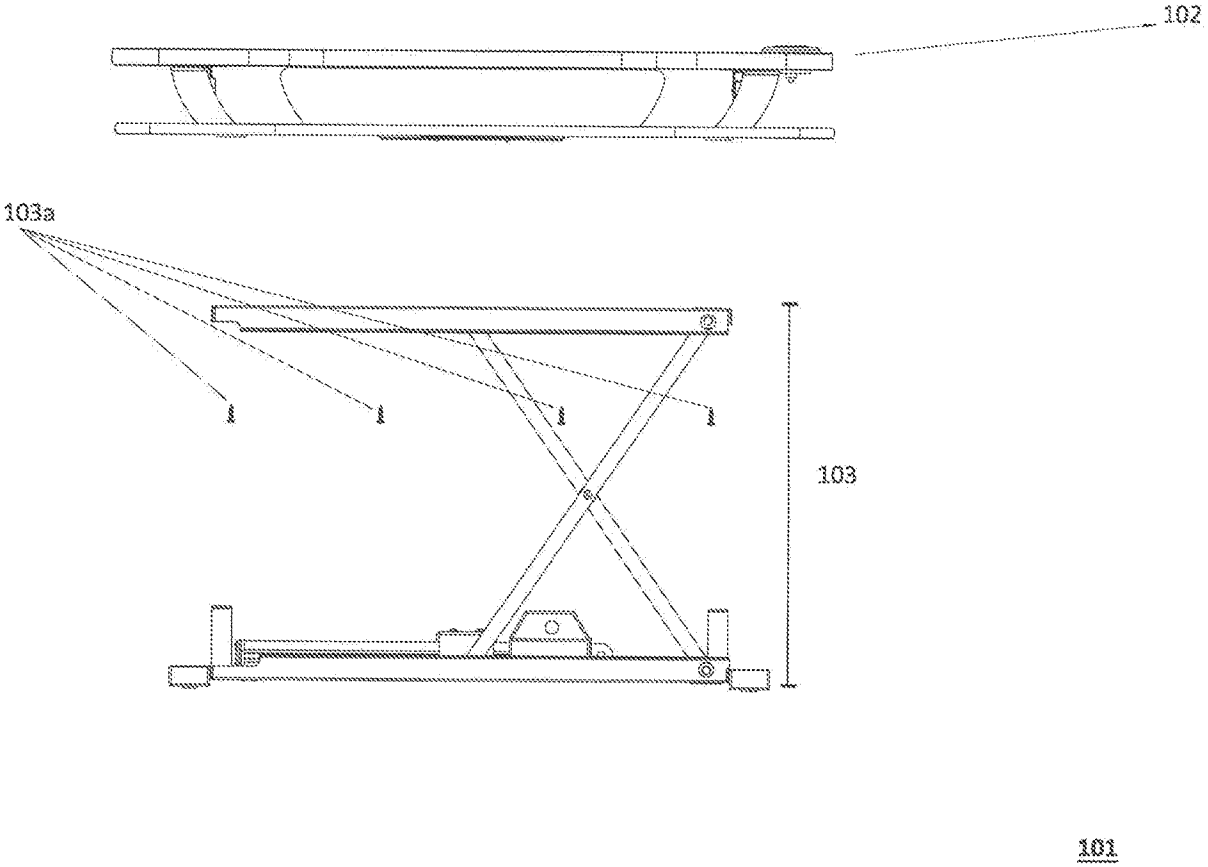
FIG. 1 shows an partial exploded view of exemplary desktop system.

A motorized desktop stand unit comprising a main surface assembly designed to accommodate a monitor or laptop; a secondary surface assembly slideably attached to said main surface assembly designed to accommodate a keyboard; a frame assembly comprising an upper frame and a lower frame; an elevation mechanism provided between said upper frame and lower frame; and a switch provided in said main surface assembly; wherein when said switch is actuated, the elevation mechanism adjusts the space between said upper frame and lower frame, changing the height of the main surface assembly.

DETAILED DESCRIPTION

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way. One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural, logical, software, electrical and other changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more communication means or intermediaries, logical or physical.

A description of an embodiment with several components in communication with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of embodiments of the present invention in which, for example, functions may be executed out of order from that shown or discussed, including substantially concurrently or in reverse order, depending on the functionality involved, as would be understood by those having ordinary skill in the art.

Referring now to the figures, FIG. 1 shows an exemplary desktop system 101 with surface assembly 102 and frame assembly 103. Frame assembly 103 comprises a scissor assembly, discussed further in detail with respect to FIG. 2. Scissor assembly aids in allowing the frame assembly 103 to be adjusted to/positioned at varying heights. Screws 103*a* are used to attach frame assembly 103 to main surface 102.

Figure 2:
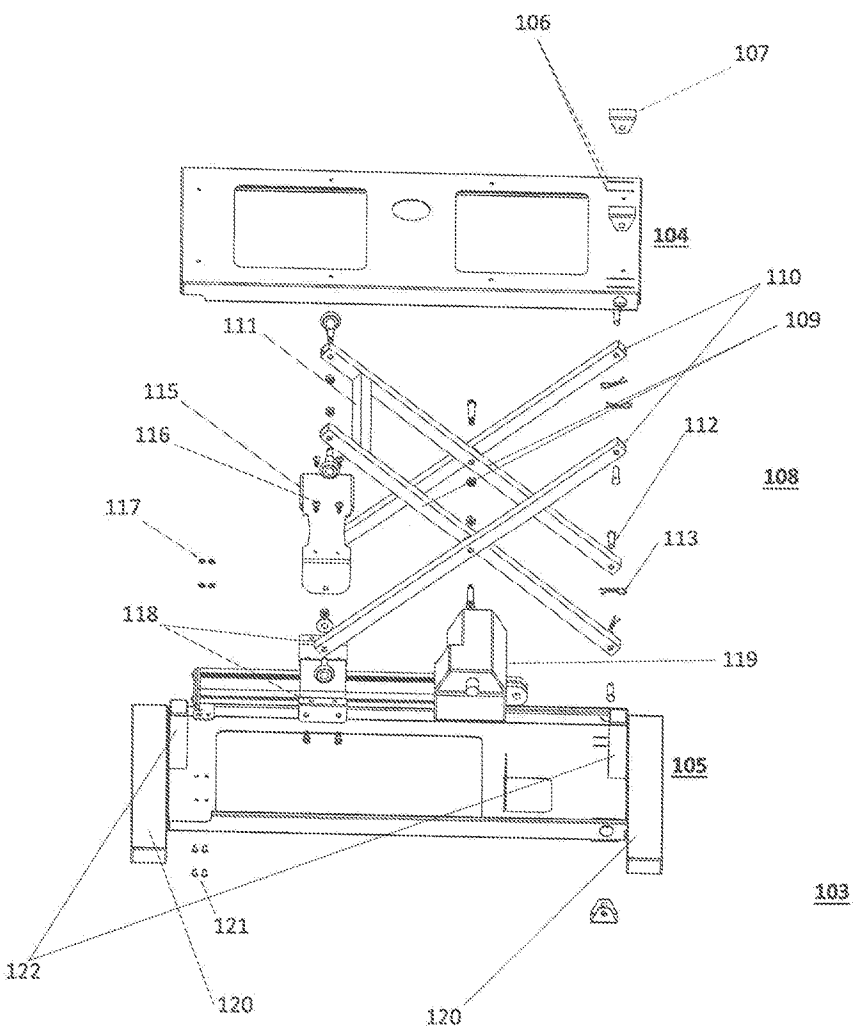
FIG. 2 shows an exploded view of the frame assembly of the exemplary desktop system.
Figure 2:
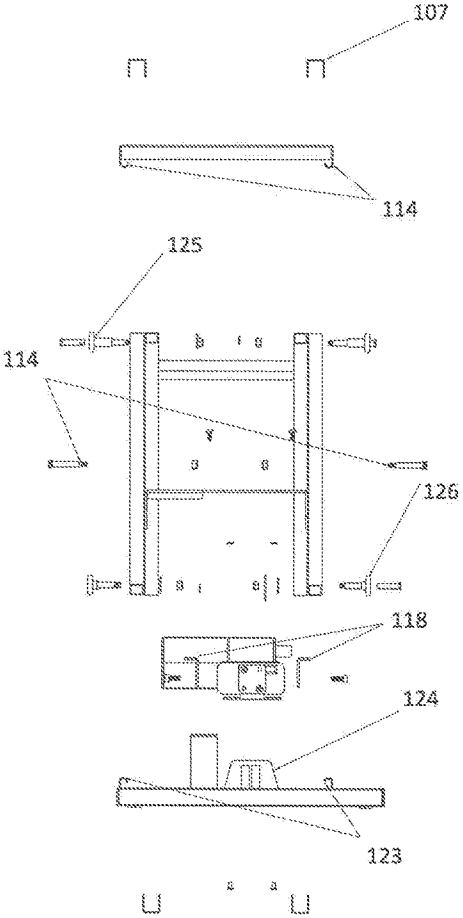

FIG. 2 shows an exploded view of frame assembly 103. Frame assembly 103 has upper tray 104 and lower tray 105. Upper tray 104 has cut outs 106 in a surface thereof to allow U-shaped hinge brackets 107 to pass through upper tray 104. U-shaped hinge brackets 107 have openings at distal ends thereof to allow the hinge brackets 107 to be secured to scissor arms 108 with fasteners. Bottom tray 105 also has cut outs and corresponding U-shaped hinge brackets to attach scissor arms to bottom tray 105.

Scissor arms 108 generally comprise inner scissor arms 109 and outer scissor arms 110. Inner scissor arms 109 and outer scissor arms 110 form a crisscross shape and move around a pin at a center of scissor arms 109 and 110. Reinforcer tube 111 is attached at one end of inner scissor arms 109 to maintain a set distance between the arms and to allow the arms to move together in parallel. Reinforcer tube 111 also gives the system stability when the frame assembly is raised into an elevated position.

Clevis pins 112 and cutter pins 113 are used to connect the scissor arms 109 and 110 to the top tray 104 and bottom tray 105 via the U-shaped hinge brackets 108.

U-shaped tracks 114 and 123 are provided in upper and lower trays 104 and 105, respectively, to accept roller wheels, discussed below. Carrier bracket 115 is provided at one end of the scissor arms 109 and 110 to transfer the force of the electric motor 119 to the scissor arms 109 and 110. Self-tapping screw 116 connects carrier bracket 115 to ear flanges 118 to connect the motor 119 to the carrier bracket 115.

Bottom tray 105 has welded tubes 120 to provide stability to the assembly. Pop rivets 121 secure the motor to the lower tray 105. Washers 117 are provided to the back of pop rivets 121. Stop tubes 122 are provided at opposing ends of lower tray 105 to provide a resting/stabilizing point for the upper tray 104. Flange 124 is provided on the lower tray to secure the back of motor 119.

Roller wheels 125 and 126 are connected at one end of scissor arms 109 and 110. Roller wheels 125 are customized and have an integrated stand off. The integrated stand off provides appropriate spacing from tube arms 109 and also for the roller wheels 125 to be placed into the U-shaped tracks 114.

Figure 3:
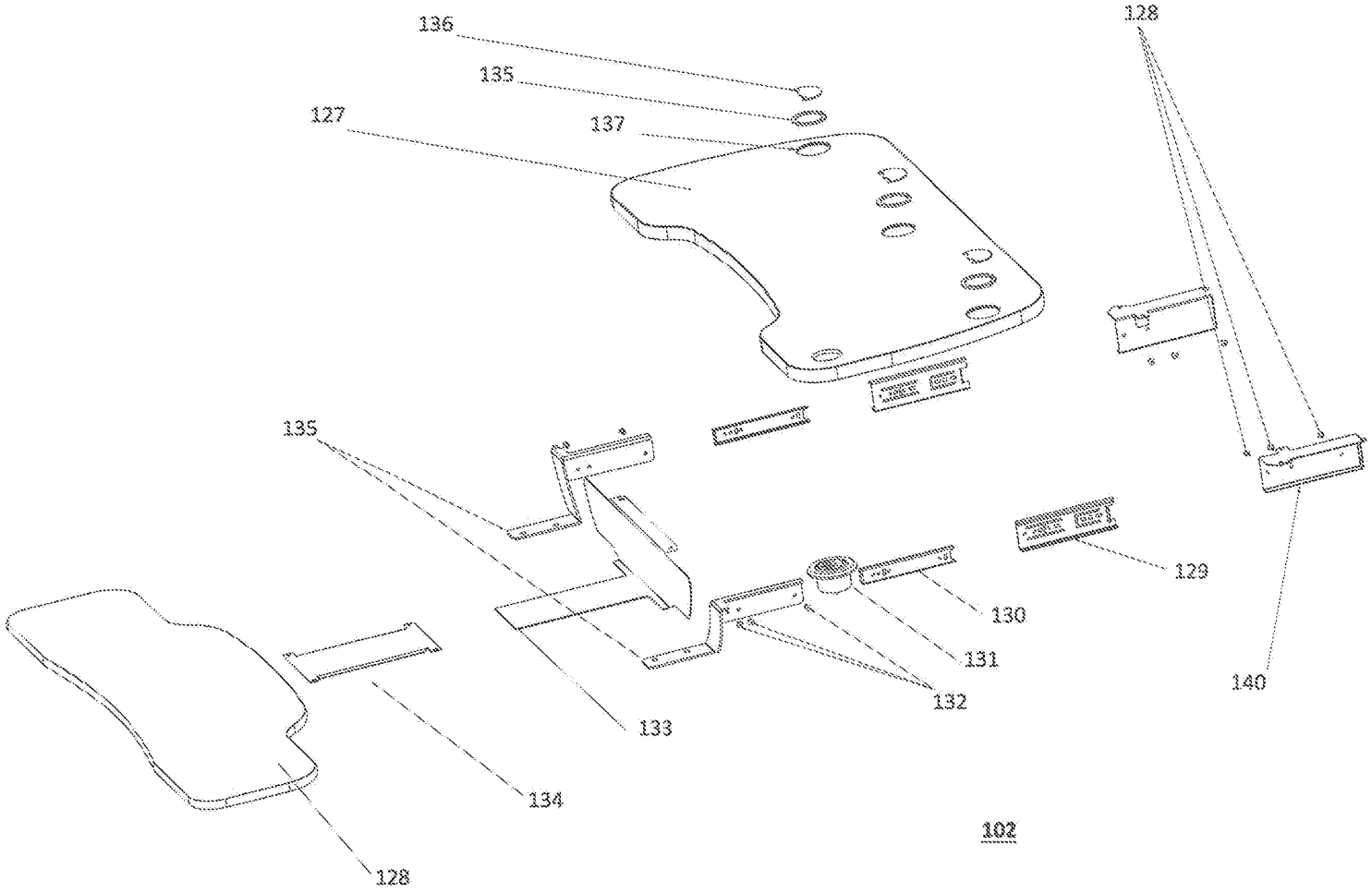
FIG. 3 shows an exploded view of the surface assembly of the exemplary desktop system.

FIG. 3 shows an exploded view of surface assembly 102. Surface assembly 102 has a main surface 127 and a keyboard tray 128. Keyboard tray is slideably attached to main surface 127 via slide bracket 140, slide outer piece 129, slide inner piece 130, surface joint and drawer slide attachment flange 135, slide flange surface joint 133, and edge folded slide guide 134. Pop rivets 128 and 132 are used to make various attachments between components. Also provided and integrated on main surface 127 is an up/down switch 131 that can be actuated to move the main surface 127 of the desktop system along a vertical axis to a desired position. Switch 131 can also have an integrated USB charger.

Keyboard tray 128 is generally provided at a position below (along a vertical axis) from main surface 127. Main surface 127 and keyboard tray 128 are attached via stationary surface joints, which are affixed to each surface via fasteners. Keyboard tray 128 is attached to main surface 127 with brackets that allow keyboard tray 128 to slide forward and backwards.

Figure 9:
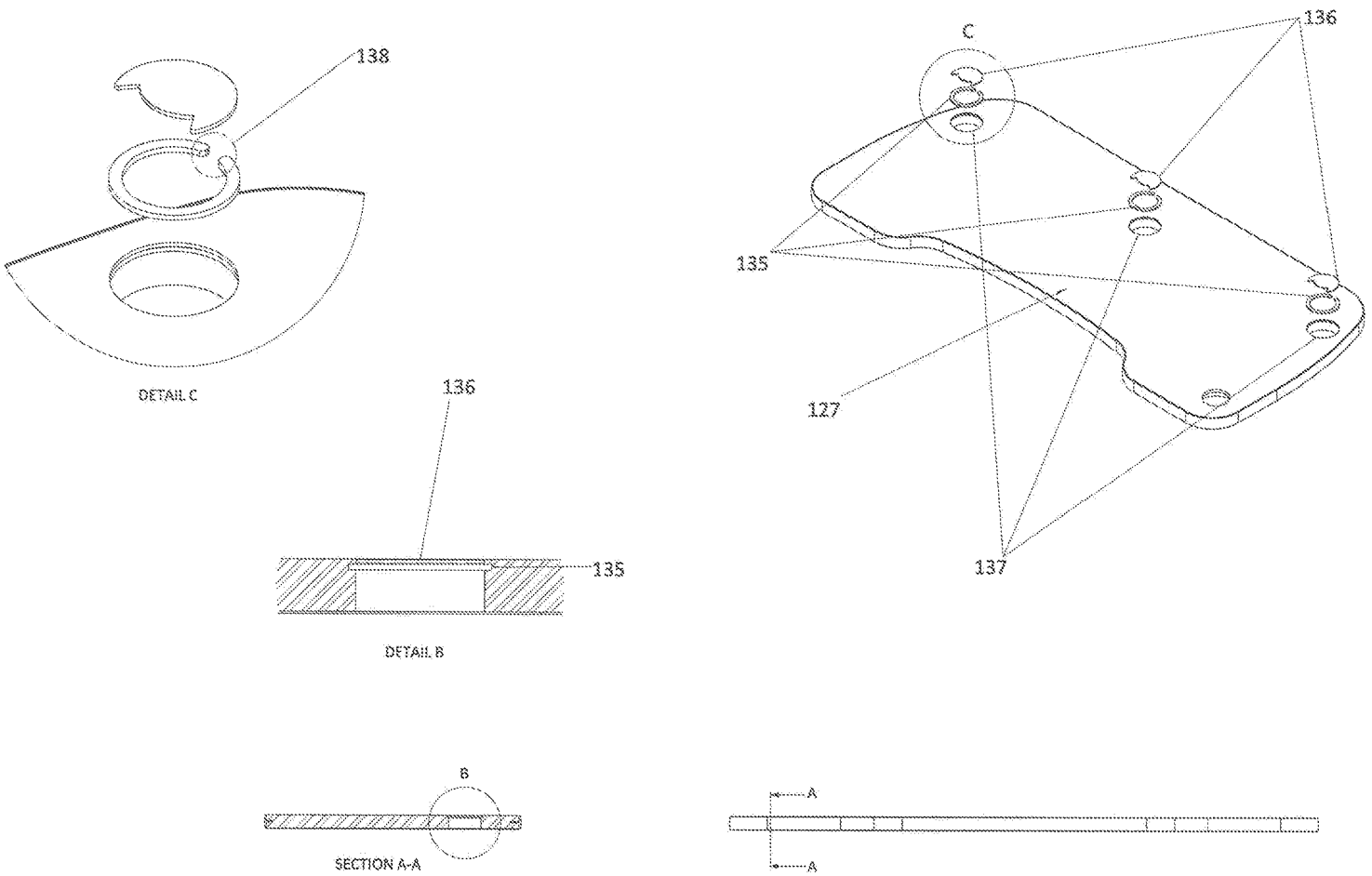
FIG. 9 shows various views of the grommet assembly.

Main surface 127 has various grommet holes 137 to allow for various cables (not shown) to pass therethrough. Grommet hole 137 holds an under grommet washer 135 and a grommet cover 136. When grommet cover 136 is placed in grommet hole 137, a flush surface is created. FIG. 9 shows further details of the grommet assembly.

Figure 4:
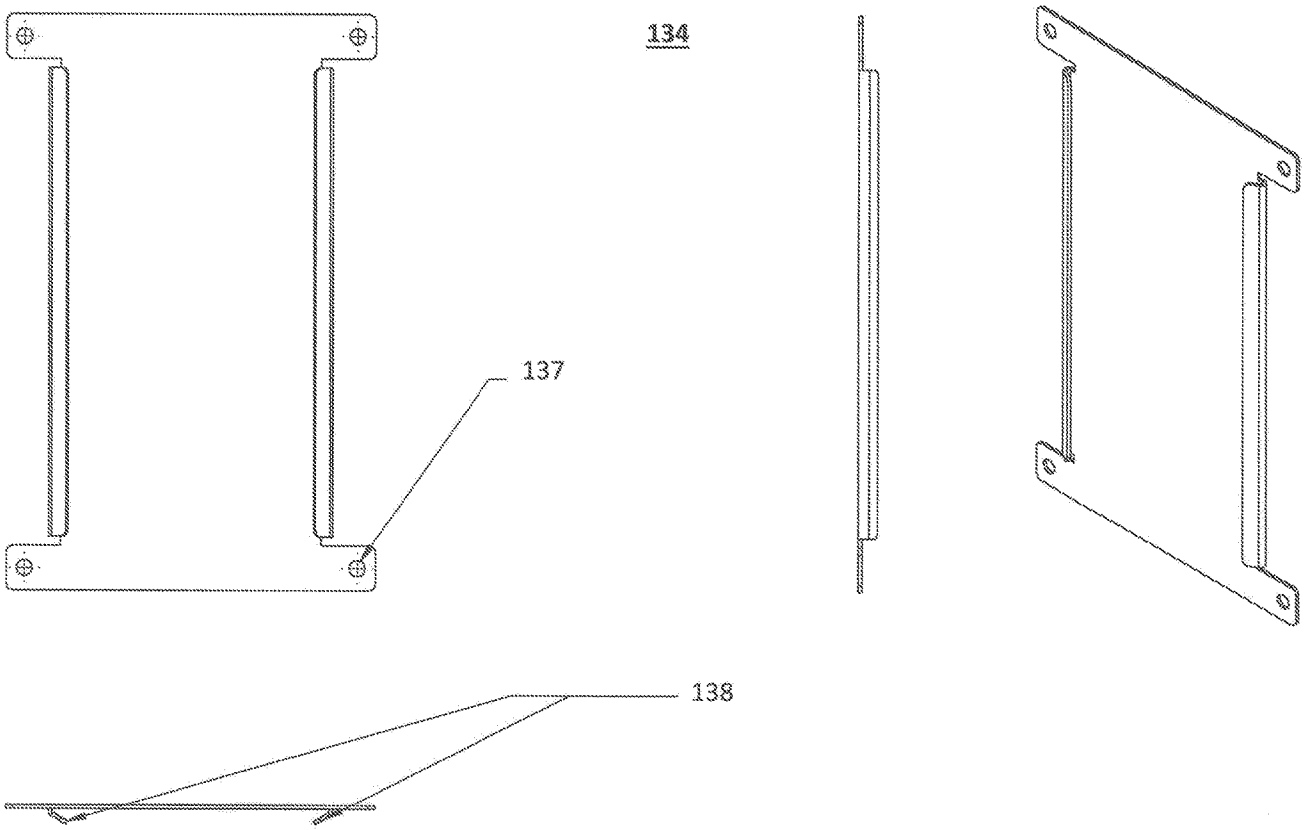
FIG. 4 shows various views of the edge-folded slide guide.
Figure 5:
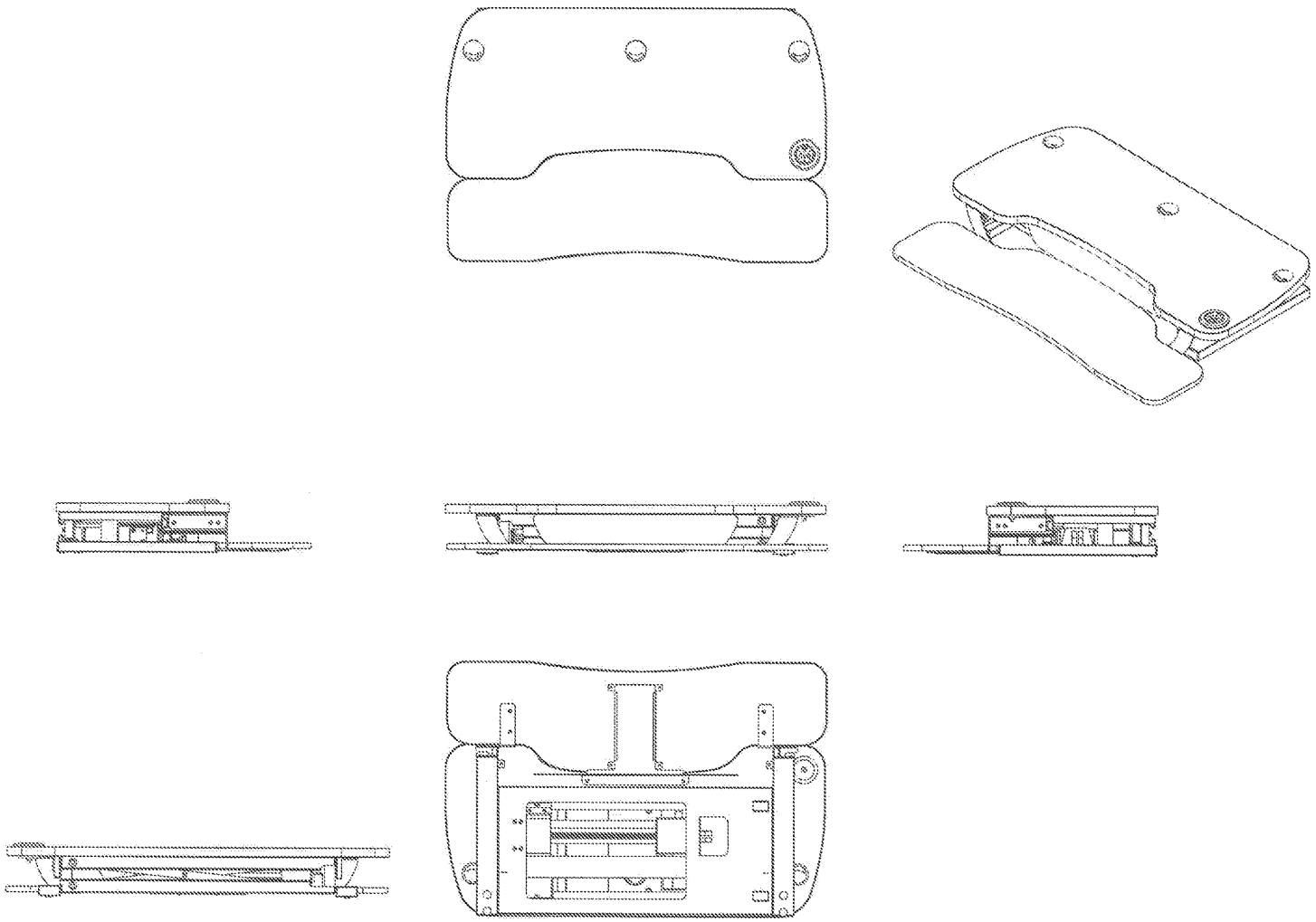
FIG. 5 shows perspective, top, bottom, and side views of the exemplary desktop system in a "down" and "closed" state.
Figure 6:
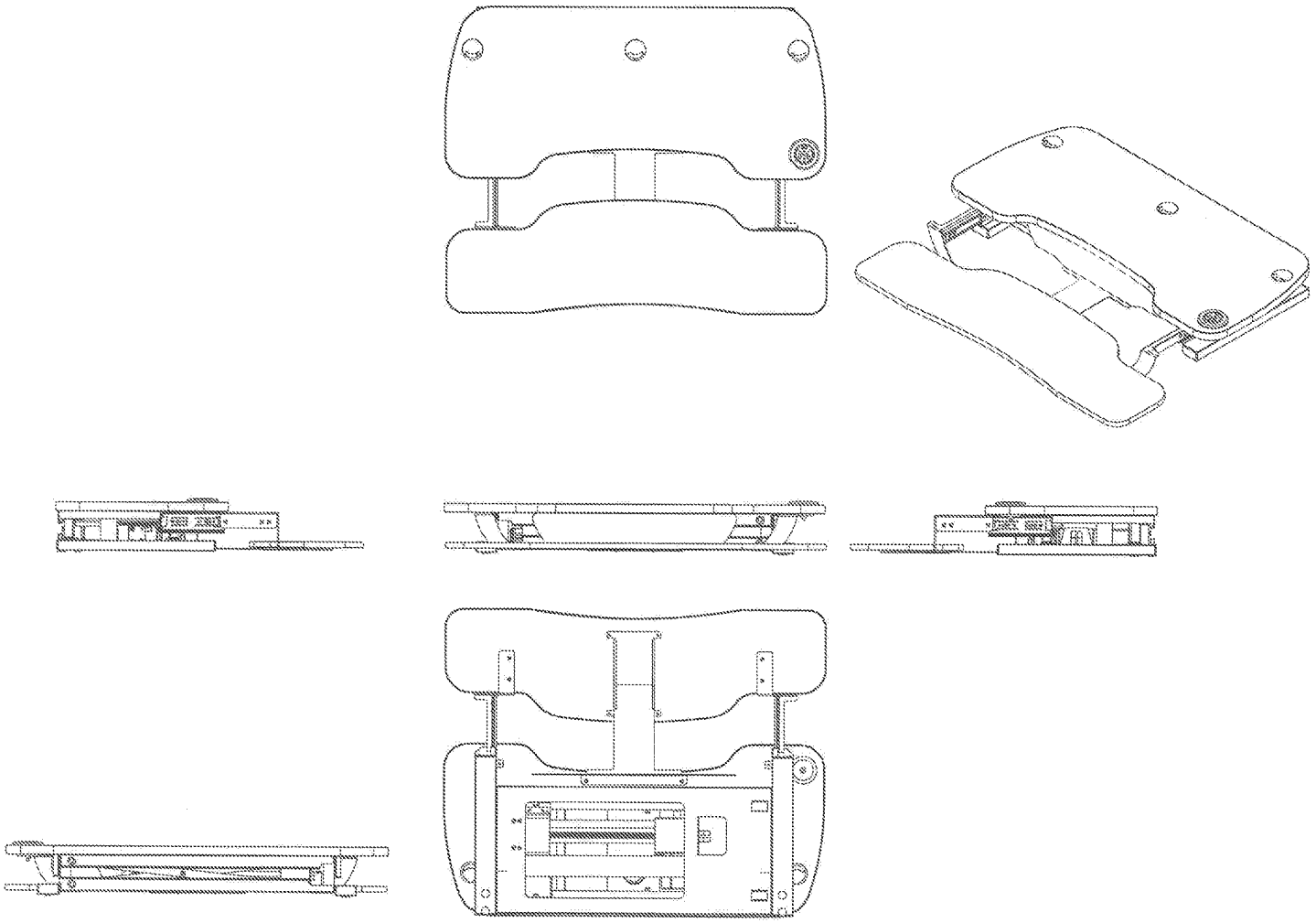
FIG. 6 shows perspective, top, bottom, and side views of the exemplary desktop system in an "down" and "open" state.

FIG. 4 shows various views of the edge folded slide guide 134. Edge folded slide guide 134 has U-shaped guides 138 for securing back and forth movement of the slide flange surface. Screw holes 137 are provided in the edge folded slide guide 134 to allow for attachment.

FIGS. 5-8 shows perspective, top, bottom, and side views of the exemplary desktop system in various "up"/"down" and "open"/"closed" states.

Figure 7:
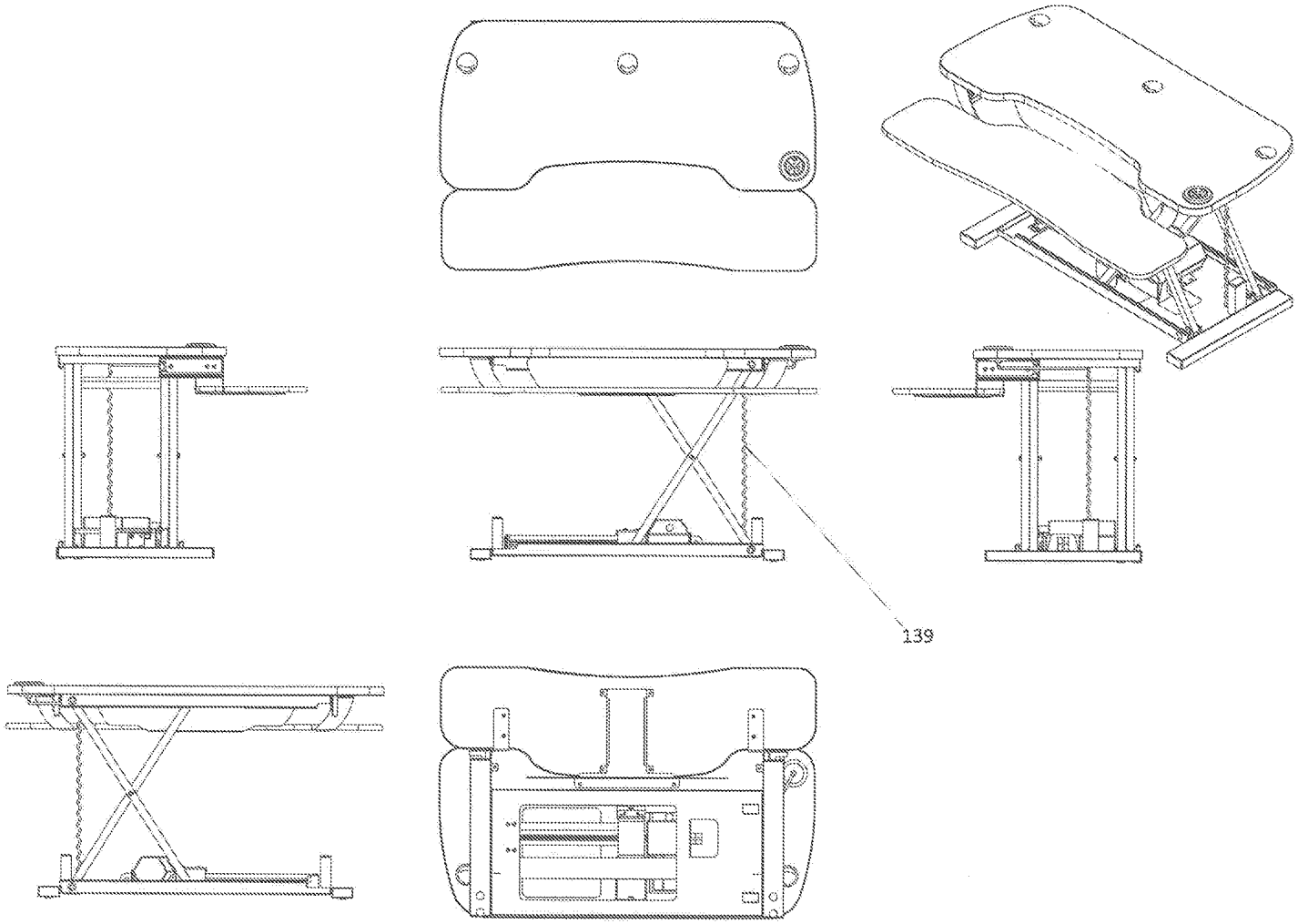
FIG. 7 shows perspective, top, bottom, and side views of the exemplary desktop system in an "up" and "closed" state.
Figure 8:
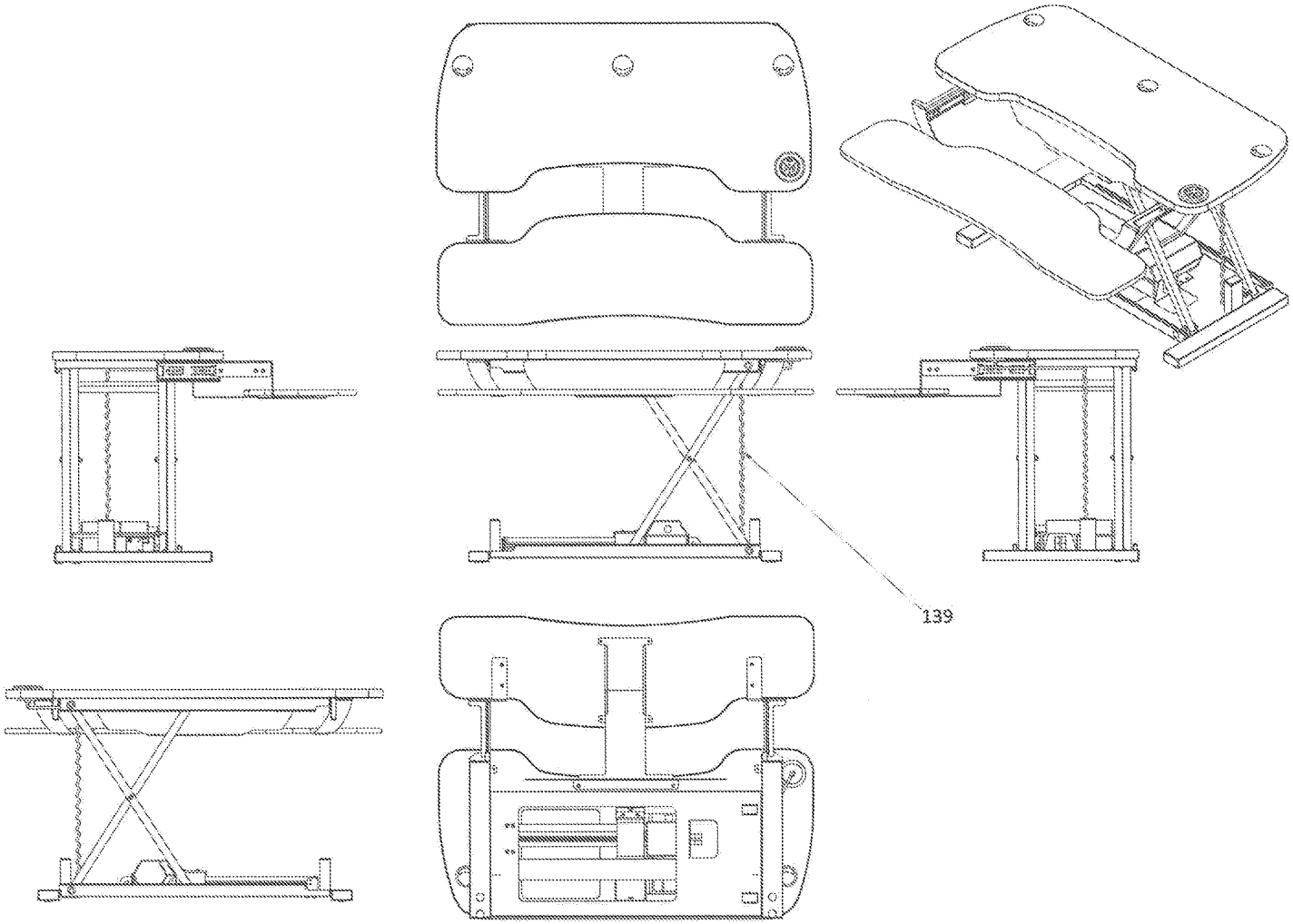
FIG. 8 shows perspective, top, bottom, and side views of the exemplary desktop system in an "up" and "open" state.

FIGS. 7 and 8 further show a coiled cord 139 to allow for effective cable management without tangling.

FIG. 9 shows main surface 127 of the surfaces assembly with grommet holes 137. Grommet hole 137 has a recessed ridge that allows grommet washer 135 to fit therein. Grommet washer 135 has a split 138 formed in the washer to allow for compression of the grommet to fit snugly within the recessed ridge. Once grommet washer 135 is placed in grommet hole, grommet cover 136 can be placed over grommet washer 135. When both grommet washer 135 and grommet cover 136 are placed in grommet hole 137, the grommet cover 136 is flush with main surface 127.

In an alternate embodiment, monitor arms may be inserted into grommet holes 137. Main surface 127 has at least one, but preferably three, grommet holes to allow for monitor arms 105 to be inserted into grommet holes. Monitor arms can be designed to support computer monitors, for example, but can support other types of screens and electronic devices. Keyboard tray is generally a flat surface capable of accommodating a keyboard, mouse, and other computer accessories.

In another exemplary desktop system, grommet hole in the center of main surface can being used by a monitor arm, which can accommodate dual screens (also referred to as "dual monitor arm"). A monitor arm capable of accommodating a single monitor, would be interchangeable by a user. Other grommet holes can similarly accommodate monitor arms of the dual or single type.

As generally discussed above, frame assembly (or lift mechanism) generally comprises upper and lower frames, and, respectively, and a linear actuator powered by a motor. Provided between and connecting upper and lower frames and are scissor arms that expand in crisscross fashion to increase the distance between upper and lower frames and fold onto each other to decrease the distance between upper and lower frames. Scissor arms can be cubic tubes, for example. Scissor arms move on roller wheels provided at an end of scissor arms. Connecting tube is also provided between scissor arms for structural support. Lift mechanism is designed to create up to an 18-inch elevation and lift up to 80 lbs. A linear actuator is a type of motor that allows movement along one axis.

Lower frame further comprises roller rail tracks on each side thereof to allow roller wheels to slide there along. Provided at the end of each roller can be stop tubes. Also on lower frame is an actuator head mounting plate to secure actuator.

Attached to the top of actuator is a moving plate, which is designed move along track. When switch is actuated, moving plate, which is attached to ends of scissor arms, move along the track, which in turn move the scissor arms in either horizontal direction, thereby raising and lowering main surface.

Actuator can be of a number of different types of actuators, for example, but without limitation, a linear track actuator or a linear telescopic rod actuator. One notable feature of this exemplary embodiment in accordance with this invention is that different types of actuators can be used.

The desktop can be available in various sizes, for example, 36", 40", and 48", in a variety of colors and finishes. An optional LED strip can also be provided for typing in dimly lit environments. Main surface 127 can be in a variety of shapes and sizes, for example, in a triangle, to fit into a corner or cubicle for enhancing even small workspaces.

As these and other variations and combinations of the features discussed above can be utilized without departing from the invention as defined by the claims, the foregoing description of exemplary embodiments should be taken by way of illustration rather than by way of limitation of the invention as defined by the claims. It will also be understood that the provision of examples of the invention (as well as clauses phrased as "such as," "e.g.", "including" and the like) should not be interpreted as limiting the invention to the specific examples; rather, the examples are intended to illustrate only some of many possible aspects.

What is claimed is:

1. A motorized desktop stand unit comprising:

a main surface assembly designed to accommodate a monitor or laptop, the main surface assembly having left, right, front, and back sides relative to a user of the monitor or laptop;

a secondary surface assembly moveably attached to, parallel to, and extending toward the user from the front side of the main surface assembly;

an upper frame attached to the bottom of the main surface assembly and a lower frame adapted to rest on an upper surface of a work area;

an elevation mechanism provided between the upper frame and the lower frame;

a switch provided in the main surface assembly;

wherein the elevation mechanism comprises two pairs of scissor arms each oriented from the left side to the right side of the main surface assembly when viewed by the user, wherein each pair of scissor arms is fixedly attached on either the left side or the right side of the upper and lower frames and wherein the distal ends from the fixedly attached ends of each pair of scissor arms are free to move left and right within rigid channels in the upper and lower frames;

wherein when the switch is actuated, the elevation mechanism adjusts the space between the upper frame and the lower frame, changing the height of the main surface assembly above the upper surface of the work area.

2. The motorized desktop stand unit of claim 1, wherein the elevation mechanism comprises a linear actuator.

3. The motorized desktop stand unit of claim 2, wherein when the switch is activated, the linear actuator retracts or extends to cause the distal ends of the two pairs of scissor arms to move either left or right and thereby either raising or lowering the main surface assembly.

4. The motorized desktop stand unit of claim 1, further comprising a transverse reinforcer element, wherein the transverse reinforcer element is attached from a first arm of a first pair of scissor arms of the two pairs of scissor arms to a first arm of the second pair of scissor arms of the two pairs of scissor arms.

* * * * *